US005916107A

United States Patent [19]

Zeyer

[11] Patent Number: 5,916,107

[45] Date of Patent: Jun. 29, 1999

[54] MULTICOMPONENT FILLING APPARATUS

[75] Inventor: Bernd Zeyer, Engelsberg, Germany

[73] Assignee: Multipond Wagetechnik GmbH, Waldkraiburg, Germany

[21] Appl. No.: 08/999,289

[22] Filed: Dec. 29, 1997

[30] Foreign Application Priority Data

Jan. 30, 1997 [DE] Germany ..... 197 03 405

[51] Int. Cl.[6] ..... B65B 1/00; B65B 5/00; B30B 9/00

[52] U.S. Cl. ..... 53/154; 53/152; 53/529; 100/215; 100/225

[58] Field of Search ..... 53/154, 152, 158, 53/147, 145, 169, 529, 237, 438, 155, 530; 221/174, 186, 289; 100/214, 225, 215, 226

[56] References Cited

U.S. PATENT DOCUMENTS

| | | | |
|---|---|---|---|
| 350,663 | 10/1886 | Curry | 100/225 |
| 2,215,094 | 9/1940 | De Mars | 226/14 |
| 3,370,549 | 2/1968 | Livingston | 53/529 |
| 3,381,440 | 5/1968 | Hullworst | 53/529 |
| 3,438,321 | 4/1969 | Gladwin | 53/530 |
| 3,584,428 | 6/1971 | Falk | 53/391 |
| 3,589,277 | 6/1971 | Gray et al. | 53/527 |
| 3,654,048 | 4/1972 | Bathgate . | |
| 3,694,992 | 10/1972 | Hunt | 53/24 |
| 4,029,746 | 6/1977 | Taub et al. | 425/363 |
| 4,081,004 | 3/1978 | Harris | 141/10 |
| 4,428,179 | 1/1984 | Jordan et al. | 53/154 |
| 4,501,107 | 2/1985 | Piotrowski | 53/529 |
| 4,506,492 | 3/1985 | Boyd | 53/473 |
| 4,703,611 | 11/1987 | Young | 53/529 |
| 4,869,049 | 9/1989 | Richards et al. | 53/459 |
| 5,046,304 | 9/1991 | Alameda et al. | 53/570 |

FOREIGN PATENT DOCUMENTS

| | | | |
|---|---|---|---|
| 1 144 641 | 2/1963 | Germany . | |
| 2030912 | 1/1972 | Germany | 100/215 |
| 27 13 923 | 10/1978 | Germany . | |
| 40 13 862 | 10/1991 | Germany . | |

OTHER PUBLICATIONS

International Search Report of Application No. EP 97 12 0869, mailed May 14, 1998.

*Primary Examiner*—Peter Vo
*Assistant Examiner*—A. Dexter Tugbang
*Attorney, Agent, or Firm*—Marshall, O'Toole, Gerstein, Murray & Borun

[57] ABSTRACT

A multicomponent filling apparatus for filling a first kind and a second kind of lumped products such as salad leaves into a container comprises a collecting container having a first portion receiving the first salad type and a second portion separated from the first portion by a partition wall for receiving the second salad type. A portion comprises at least one hinged base which forms the bottom and may swing downwards into an open position, a partition wall disposed above the hinged base for forming a first hinged base portion for the first product type and a second hinged base portion for the second product type. A pressing device comprises a first pressing portion cooperating with the first hinged base portion and a second pressing portion cooperating with the second hinged base portion, whereby the two pressing portions can be reciprocated relative to the hinged base portion in a first upward direction away from the hinged base portion for supplying product and in a second direction towards the hinged based portion for compressing the product. This apparatus provides for filling two salad types separately into a container and compressing the same to a predetermined volume.

12 Claims, 4 Drawing Sheets

MULTICOMPONENT FILLING APPARATUS

BACKGROUND OF THE INVENTION

The invention relates to a multicomponent filling apparatus for filling a first type and a second type of lumped products such as salad leaves into a container.

In case that several types of salad shall be filled separately into a container and packaged therein, the various salad types are weighed separately and thereafter supplied to the cup. However, this procedure causes undesired mixtures in a considerable extent.

The U.S. Pat. No. 2,215,094 discloses a filling apparatus for introducing for example salad into a frame having movable sidewalls. After this introduction the products are filled into a container using a pressing device. It is known from document DE 40 13 862 A to use a collecting container with openable bottom flap for filling packages.

OBJECTS OF THE INVENTION

It is the object of the invention to provide an improved multicomponent filling apparatus. It is a further object to provide a multicomponent filling apparatus for filling various types of lumped products such as salad leaves separately into containers, thereby allowing a separate storage and packaging of the products in the container.

SUMMARY OF THE INVENTION

In order to achieve the above-mentioned objects the invention provides a multicomponent filling apparatus for filling a first type and a second type of lumped products such as salad leaves into a container, said filling apparatus comprising a collecting receptacle having a first portion for receiving said first product type, a second portion for receiving said second product type and a partition means separating said first portion from said second portion, said collecting receptacle having a hinged base portion forming a bottom portion of said receptacle, means for swinging said hinged base portion downwards into an open position, a partition wall disposed above said hinged base portion to separate said hinged base portion into a first hinged base portion for said first product type and a second hinged based portion for said second product type, pressing means comprising a first pressing portion cooperating with said first hinged base portion and a second pressing portion cooperating with said second hinged base portion, and means for moving said pressing means relative to said hinged base portion in a first upward direction away from said hinged base portion for supplying products into said receptacle and in a second downward direction towards said hinged base portion for compressing said products and filling the same into said container.

BRIEF DESCRIPTION OF THE DRAWINGS

Further features and advantages of the invention will be apparent from the description of embodiments with reference to the Figures. In the Figures.

DESCRIPTION OF PREFERRED EMBODIMENTS

Figure 2:
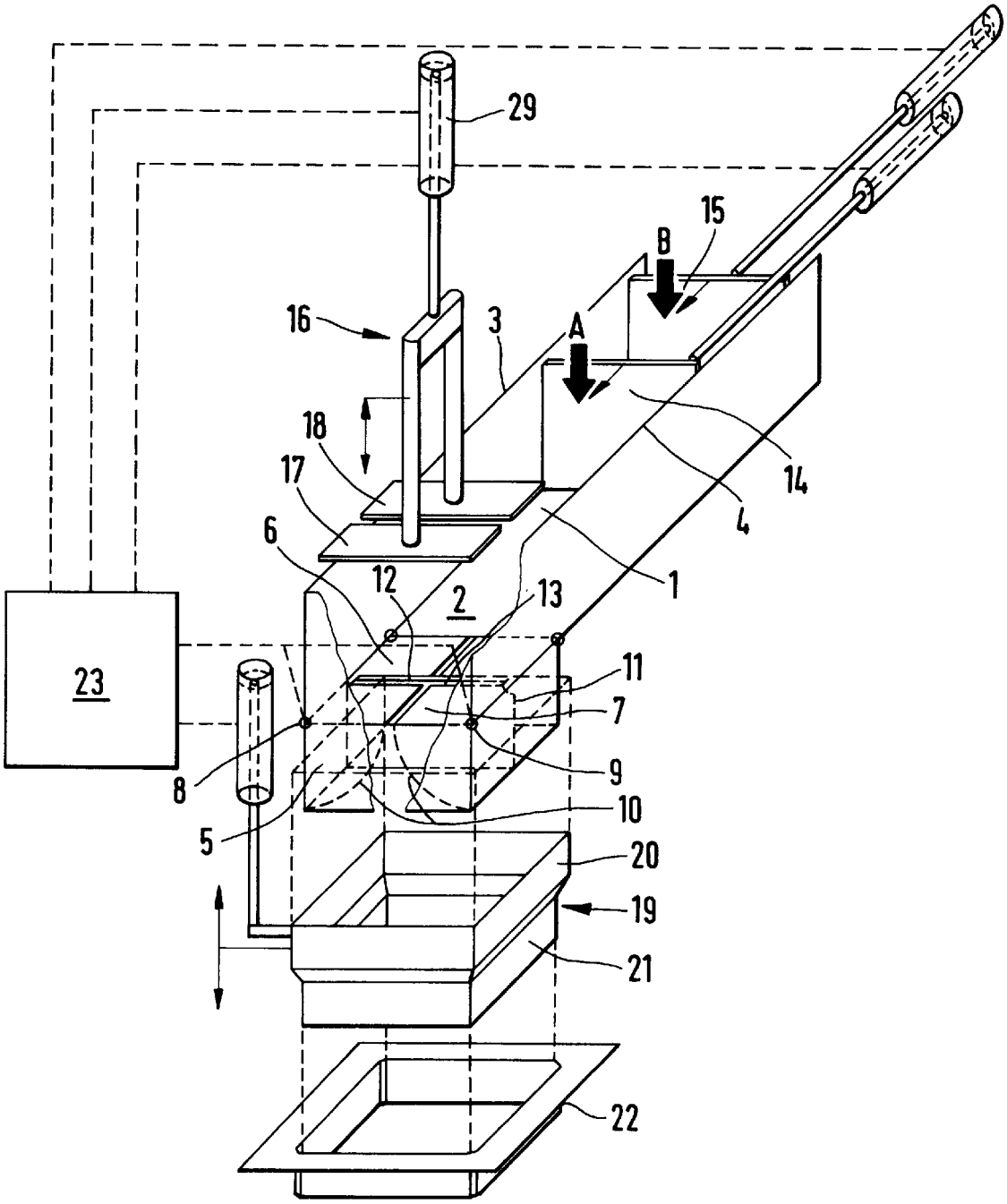
FIG. 2 shows a first embodiment of the multicomponent filling apparatus.

As shown in FIG. 2 the multicomponent filling apparatus comprises a substantially horizontal channel 1 having a bottom 2, sidewalls 3 and 4 and a front wall 5. In the channel region adjacent to the front wall 5 the bottom 2 is formed by two flaps 6, 7 which can be each swung downwards by 90° in the manner indicated by the arrows 10 around respective axes 8, 9 extending parallel to the sidewalls 3, 4 and contingent therewith.

As shown in the figure the sidewalls and the front wall extend downwards in the region of the flaps 6, 7 by an extent which corresponds to the width of the flaps, i.e. to half of the width of the channel in the embodiment shown in the figure. A portion corresponding to the front wall portion is fixed on the side of the hinged base formed by the flaps opposite to the front wall. Thus, a downwardly directed shaft is created. A vertically downwards extending partition wall 11 is disposed within this shaft parallel to the front wall and at a distance therefrom which corresponds to half of the length of the hinged base extending in longitudinal direction of the channel. The partition wall divides the lower shaft portion into two halves. The two flaps have slits 12, 13 formed along the partition wall so that the flaps can freely swing downwards.

A second partition wall 14 is provided within the channel at a preselected distance from the hinged base formed by the flaps 6, 7. The second partition wall 14 can be reciprocated between the aforementioned position and a position directly above the first mentioned partition wall 11. A back wall 15 forming the back end of the channel is provided in the channel at the side of the second partition wall opposite to the front wall 5 and spaced therefrom. The back wall 15 can be reciprocated between the position shown in the figure and a position directly at the side of the hinged base opposite to the front wall 5. A pressing device 16 having a first pressing portion 17 and a second pressing portion 18 is arranged above the hinged base. The form and size of the two pressing portions correspond substantially to the two halves of the hinged base separated by the first partition wall 11 and are smaller than the hinged base portion defined by the front wall and the sidewalls by such an amount that they can freely move up and down within this portion. The pressing device can be moved from a first position shown in FIG. 2 whereby the pressing device is above the channel 1 towards the hinged base into a second position having an adjustable distance from the hinged base.

As shown in FIG. 2 a hopper 19 is disposed below the shaft at the underside of the hinged base. The hopper 19 comprises an upper wall portion 20 with vertical walls which are sized to encompass the outside of the shaft thereabove, as indicated by the dotted lines. The upper wall portion 20 is followed downwardly by a second wall portion 21 having outer dimensions which correspond to the inner dimensions of a container 22 to be filled or are smaller than the inner dimensions of the container 22 by such an amount that the hopper can easily enter the container for filling the same.

As shown in FIG. 2 the movable parts, e.g. the two flaps 6, 7, the second partition wall 14 and the back wall 15, the pressing device 16 and the hopper 19 are each connected with schematically indicated drives, in particular pneumatic drive means, for carrying out the above-described movements. The pneumatic drive means themselves are connected with a control unit 23 as schematically indicated.

Figure 1:
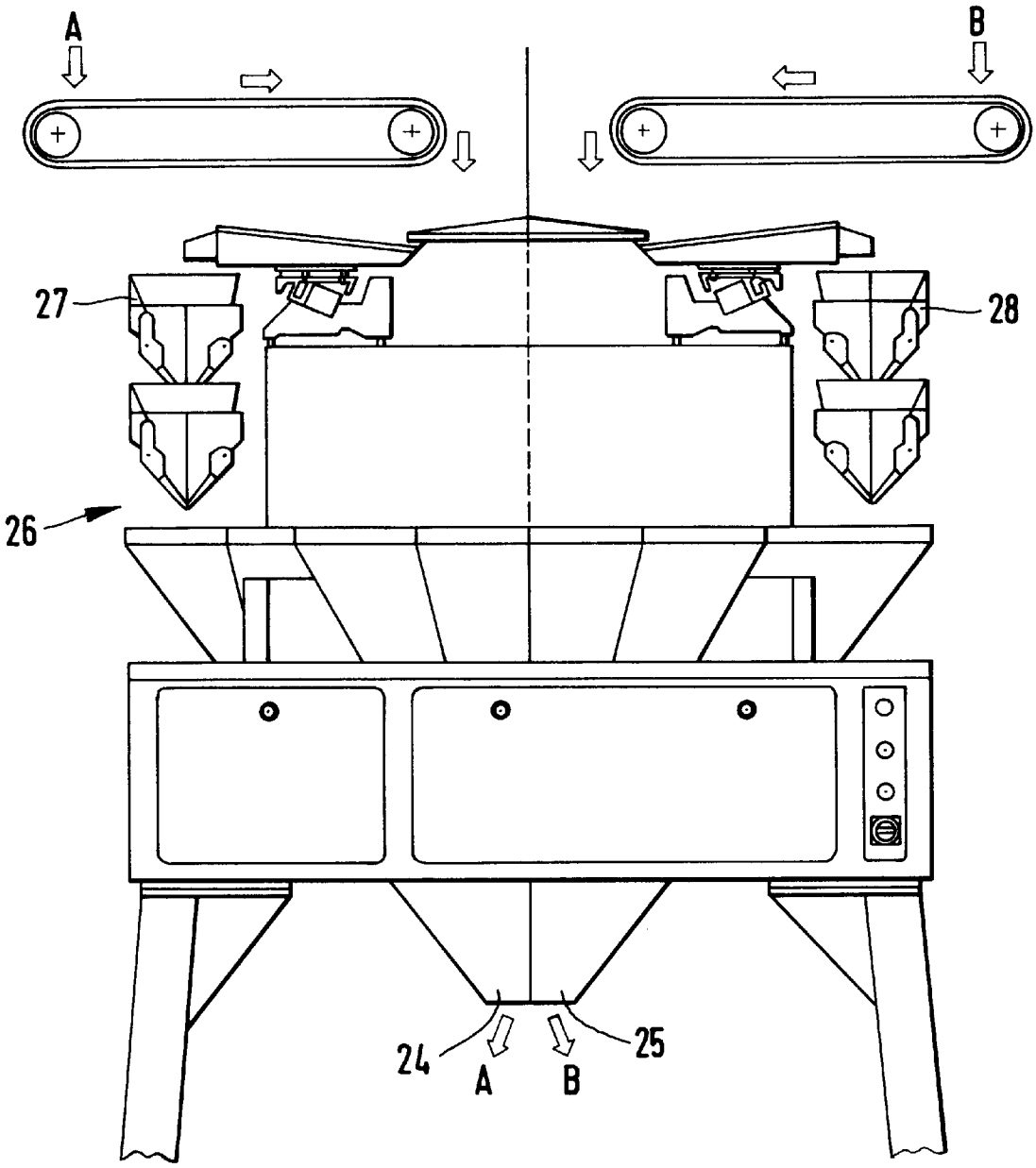
FIG. 1 is a side view of a combinatorial weighing apparatus.

Two discharge openings 24, 25 of a per se known combinatorial weighing apparatus 26, as shown in FIG. 1, open from above into the first region between the hinged base and the second partition wall 14 and into the second region between the second partition wall 14 and the back wall 15, resp. The weighing heads of the weighing apparatus are divided into a first group 27 and a second group 28. A corresponding type of product to be filled, in the present case a type of salad, is fed to each region via belt conveyors indicated in the drawing. The total weight of both types of salad and the component weight for one salad type are predetermined. The second salad type is weighed to equilibrate the predetermined total weight. The total weight and component weight of the overall portion to be delivered are determined according to the principle of combinatorial weighing.

After having introduced the two salad types into the two regions divided by the second partition wall 14 the control unit 23 triggers the movement of the second partition wall 14 from the shown position into a position above the first partition wall 11 and the movement of the back wall 15 from the shown position into a position at the side of the hinged base opposite to the front wall. Thereafter the control unit 23 initiates the lowering of the pressing portions 17, 18 down to the predetermined distance above the hinged base. This compresses the salad leaves to a preselected volume so that the volume is reduced to a preselected amount. In the next step the control unit completely opens the hinged base by folding the flaps downwards by 90°, and the pressing device continues to descend to such an extend that the salad is completely pressed out of the shaft and falls through the hopper into the container 22. The two salad types fall side by side into the respective half of the container. Thereafter the hopper is returned into the upper position indicated in dotted lines, whereby the container can be transported laterally along the plane thereof. The flaps 6, 7, the pressing device 16 and the walls 14, 15 are returned into their starting positions for the next filling cycle.

Figure 3:
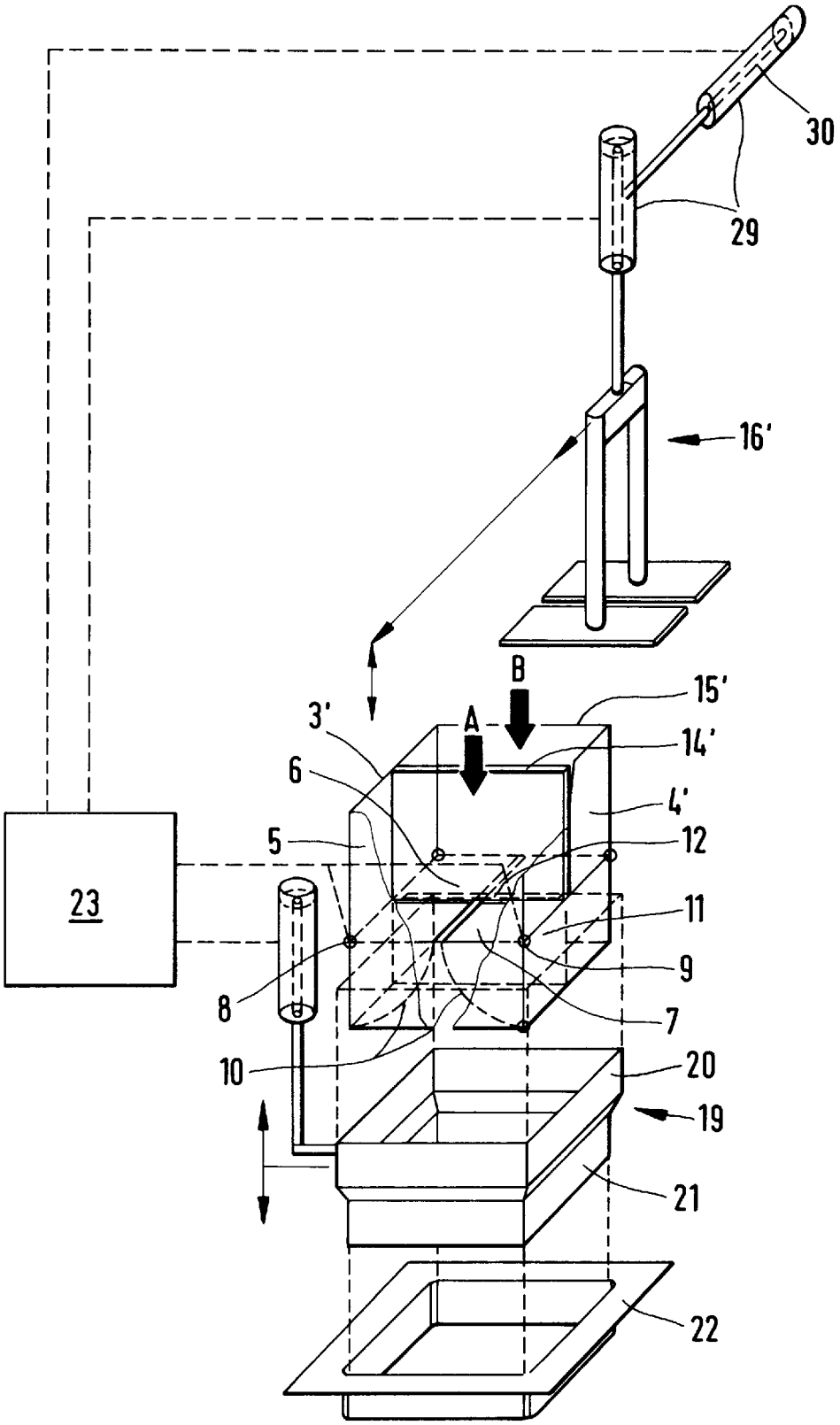
FIG. 3 shows a second embodiment of the multicomponent filling apparatus.

In FIG. 3 the same reference signs are used for the same parts. In a manner different from the initially described embodiment the channel is formed merely by sidewalls 3', 4', the front wall 5 and a back wall 15' as well as a bottom portion consisting only of the two flaps 6, 7. Hence, the cross-sectional size of the channel equals the bottom area formed by the flaps 6, 7. The pressing device 16' is movable by means of a drive 29 controlled by the control unit 23 not only in a reciprocating manner between a lowered position within the channel and a raised position in the above-described manner, but also, using a second drive 30, in a direction laterally away from the upper opening of the channel in its raised position to clear the access of the opening.

The second partition wall 14' is mounted in a fixed position corresponding to the above-described end position above the lower partition wall 11.

The operation of the second embodiment differs from that of the initially described embodiment only in that the pressing device 16' is held laterally of the shaft for filling the same to clear both openings for introducing salad leaves thereinto from the two discharge openings 24 and 25. Thereafter the pressing device is moved to a position above the shaft and the operation is continued in the same manner as described above, whereby both salad types are filled into the container 22 separately and side by side.

Figure 4:
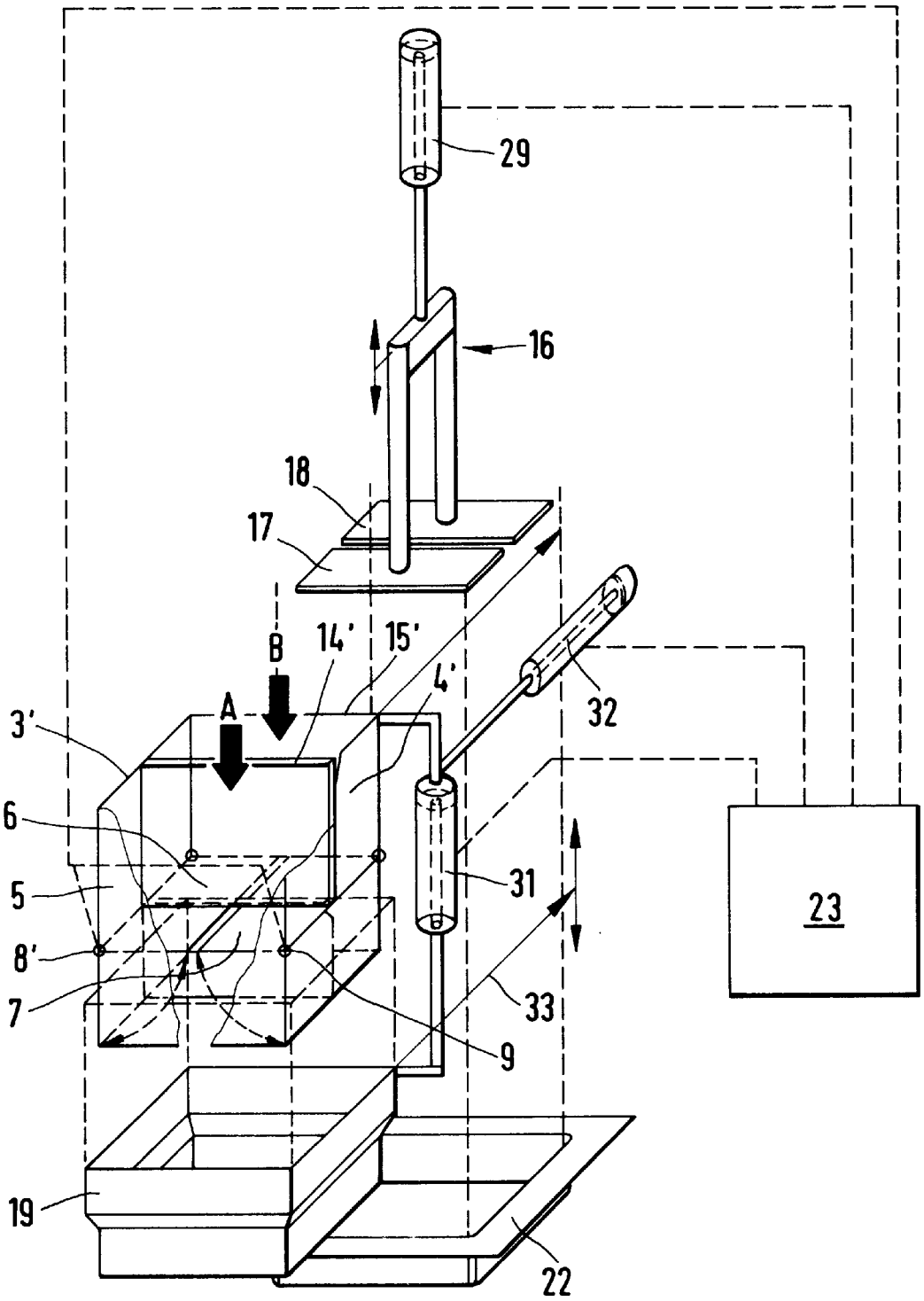
FIG. 4 shows a third embodiment of the multicomponent filling apparatus.

A further modified embodiment is shown in FIG. 4. The parts corresponding to those of the first embodiment shown in FIG. 2 or those of the second embodiment shown in FIG. 3 are identified by the same reference signs. The shaft comprising the sidewalls 3', 4', 5 and 15' and the associated partition walls as well as the hopper 19 correspond to the second embodiment shown in FIG. 3. The pressing device 16 corresponds to that of the first embodiment shown in FIG. 2. It is the difference from the second embodiment that the lateral movement of the pressing device 16' relative to the shaft and the hopper is not effected by vertically and laterally displacing the pressing device using the first drive 29 and the second drive 30, but by simultaneously offsetting the shaft and the hopper 19 laterally in relation to the pressing device 16. A third drive 31 and a fourth drive 32 are provided to this purpose and both drives are controlled by the control unit 23 as all the other drives. The shaft and the hopper 19 are supported in a not-shown frame for reciprocally moving the hopper 19 relative to the shaft in vertical direction between a raised position shown in dotted lines and a position whereby it is lowered into the container 22 by means of the third drive 31. Furthermore, the support in the frame is designed so that a fourth drive 32 effects a transverse displacement indicated by an arrow 33 in the raised position of the hopper shown in dotted lines in such a manner that in the shown filling position the shaft and the hopper are laterally offset with respect to the pressing device to thereby enable filling of the shaft from the combinatorial weighing apparatus thereabove, and that the shaft and the hopper 19 are laterally displaced in the second position in the manner indicated with dotted lines in FIG. 4 in such a manner that the shaft and the hopper are both aligned directly below the pressing device, whereby the hopper 19 is positioned above the container 22 to be filled.

In operation first the cups A and B are filled. Thereafter the lateral displacement is effected and the pressing device operates for compression and subsequent filling through the hopper into the container 22. Thereafter the pressing device 16 is retracted and the shaft and hopper are laterally displaced to start a new filling operation.

In both embodiments the two flaps 6, 7 can be substituted by a single flap supported at one side and having a double size. In this case the shaft must have a correspondingly greater length.

The above-described embodiments are each adapted to two salad components and have a first compartment A and a second compartment B with correspondingly adapted members in the shaft and at the pressing device. In case that it is desired to fill more than two salad types or species of lumped products side by side into a container, a corresponding number of container portions of the corresponding partitioning means and a pressing device having a corresponding number of pressing portions are used.

Although the invention has been described with reference to a specific example embodiment, it is to be understood that it is intended to cover all modifications and equivalents within the scope and spirit of the appended claims.

What is claimed is:

1. A multicomponent filling apparatus for filling a first type and a second type of lumped products into a container, said filling apparatus comprising:

a collecting receptacle having a first portion for receiving said first product type, a second portion for receiving said second product type and a first partition wall separating said first portion from said second portion, said collecting receptacle having a hinged base forming a receptacle bottom said first partition wall being disposed beneath said hinged base;

means for swinging said hinged base downwards into an open positions a second partition wall disposed above said hinged base in substantial alignment with said first partition wall to separate said hinged base into a first hinged base area on a first side of said second partition wall for said first product type and a second hinged base area on a second side of said second partition wall for said second product type;

a press having a first pressing portion cooperating with said first hinged base area and a second pressing portion cooperating with said second hinged base area; and means for moving said first and second press portions relative to said hinged base in a first upward direction away from said hinged base to permit insertion of said first and second product types into said receptacle and in a second downward direction towards said hinged base for compressing said first and second product types and, upon swinging of said hinged base into the open position, filling first and second product types into said container.

2. A multicomponent filling apparatus a defined in claim 1, wherein the first pressing portion is separated from said second pressing portion by a slit, said slit having an orientation which corresponds to said first partition wall.

3. The multicomponent filling apparatus a defined in claim 1 further comprising:

a channel which is laterally contingent to said hinged base and in communication with the receptacle, the channel being defined by a bottom and lateral walls, the lateral walls extending along said hinged bases;

a front wall arranged at a side of said hinged base opposite to said channel and oriented perpendicular to said hinged base; means for moving said first partition wall within said channel in a reciprocating manner between a first position wherein said first partition wall is disposed above said hinged base and a second position wherein said first partition wall is moved away from said hinged base by a predetermined distances;

a back wall provided in said channel opposite to said front wall, said back wall being spaced a distance from said first partition wall;

means for reciprocating said back wall between a first position wherein said back wall is disposed a distance away from said receptacle, and a second position wherein said back wall forms a sidewall of said receptacle.

4. The multicomponent filling apparatus as defined in claim 1, further comprising a hopper disposed below the hinged base of said collecting receptacle and means for reciprocating said hopper between a raised position and a lowered position.

5. The multicomponent filling apparatus a defined in claim 1, further comprising a weighing apparatus for separately supplying said first product type and said second product type into said collecting receptacle.

6. The multicomponent filling apparatus as defined in claim 1 wherein the second partition wall is moveable.

7. The multicomponent filling apparatus as defined in claim 1 wherein the hinged base comprises two hinged flaps.

8. The multicomponent filling apparatus as defined in claim 7 wherein each of the flaps defines a slit located to permit swinging of the flaps without interference from the first partition wall.

9. The multicomponent filling apparatus as defined in claim 1 wherein the hinged base defines a slit located to permit swinging of the hinged base without interference from the first partition wall.

10. The multicomponent filling apparatus as defined in claim 1 wherein said press is laterally moveable relative to said receptacle to facilitate insertion of said first and second product types into the receptacle.

11. The multicomponent filling apparatus as defined in claim 1 wherein said receptacle is laterally moveable relative to said press to facilitate insertion of said first and second product types into the receptacle.

12. The multicomponent filling apparatus for filling a first type and a second type of lumped products into a container, said filling apparatus comprising:

a collecting receptacle having a first portion for receiving said first product type, a second portion for receiving said second product type and a first partition wall separating said first portion from said second portion, said collecting receptacle having a hinged base forming a receptacle bottom, said first partition wall being disposed beneath said hinged base;

a second partition wall disposed above said hinged base to separate said hinged base into a first hinged base area on a first side of said second partition wall for said first product type and a second hinged base area on a second side of said second partition wall for said second product type;

a shaft disposed below the receptacle and sized to permit downward swinging of the hinged base to an open position without interference therewith, the first partition wall being disposed within the shaft in substantial vertical alignment with the second partition wall such that the first product type remains separated from the second product type when said first and second product types pass through the shaft; and a press having a first pressing portion cooperating with said first hinged base area and a second pressing portion cooperating with said second hinged base area, first and second press portions being moveable relative to said hinged base in a first upward direction away from said hinged base to permit insertion of said first and second product types into said receptacle and in a second downward direction towards said hinged base for compressing said first and second product types and, upon swinging of said hinged base into the open position, for filling said first and second product types into said container.

* * * * *